US005099531A

United States Patent [19]

Schmier

[11] Patent Number: 5,099,531

[45] Date of Patent: Mar. 31, 1992

[54] BUTTON ALIGNMENT AND STABILIZING SYSTEM FOR BEDDING

[76] Inventor: Kenneth J. Schmier, 1863 San Antonio Ave., Berkeley, Calif. 94707

[21] Appl. No.: 504,947

[22] Filed: Apr. 5, 1990

[51] Int. Cl.[5] ..... A47C 21/02

[52] U.S. Cl. ..... 5/460; 5/494; 5/496; 5/498; 5/502

[58] Field of Search ..... 5/494, 496, 498, 499, 5/502, 460; 24/72.5

[56] References Cited

U.S. PATENT DOCUMENTS

| | | | |
|---|---|---|---|
| 1,742,064 | 12/1929 | Dinstuhl . | |
| 1,833,298 | 11/1931 | Oakey . | |
| 2,024,050 | 12/1935 | May . | |
| 2,221,114 | 11/1940 | Schwartz . | |
| 2,284,778 | 6/1942 | Treiber . | |
| 2,333,652 | 11/1943 | Koster . | |
| 2,497,186 | 2/1950 | Pedersen . | |
| 2,644,173 | 7/1953 | James . | |
| 2,729,831 | 1/1956 | Fuld et al. . | |
| 2,736,043 | 2/1956 | Temple | 5/502 |
| 2,789,292 | 4/1957 | Budinquest . | |
| 2,799,870 | 7/1957 | Sullivan | 5/502 X |
| 3,083,378 | 4/1963 | Pursell . | |
| 4,021,869 | 5/1977 | Root . | |
| 4,292,700 | 10/1981 | Markel . | |
| 4,344,196 | 8/1982 | Large | 5/496 |
| 4,660,240 | 4/1987 | Hutton et al. | 24/72.5 X |
| 4,662,016 | 5/1987 | Seeman | 5/498 X |

FOREIGN PATENT DOCUMENTS

| | | |
|---|---|---|
| 1327198 | 4/1963 | France . |
| 119424 | 3/1927 | Switzerland . |
| 452823 | 5/1968 | Switzerland . |

*Primary Examiner*—Michael F. Trettel
*Attorney, Agent, or Firm*—Philip A. Dalton

[57] ABSTRACT

The present invention attaches a row of fasteners such as buttons along the foot of a mattress. Holes are also provided in associated sheets, blankets, comforters and other covers. Preferably, the fasteners are mounted on fairly long, flexible shanks so that they can pass through the holes in the layers of covers to secure and automatically align the covers relative to the mattress and to one another. The covers may be fastened to one another at the top edges thereof using fasteners such as button tracks. The foot and edge fasteners facilitate making and remaking the bed covers. Also, the fasteners and holes may be formed in a standardized configuration and spacing to provide upward and downward compatibility among different mattress sizes.

7 Claims, 2 Drawing Sheets

FIG-1
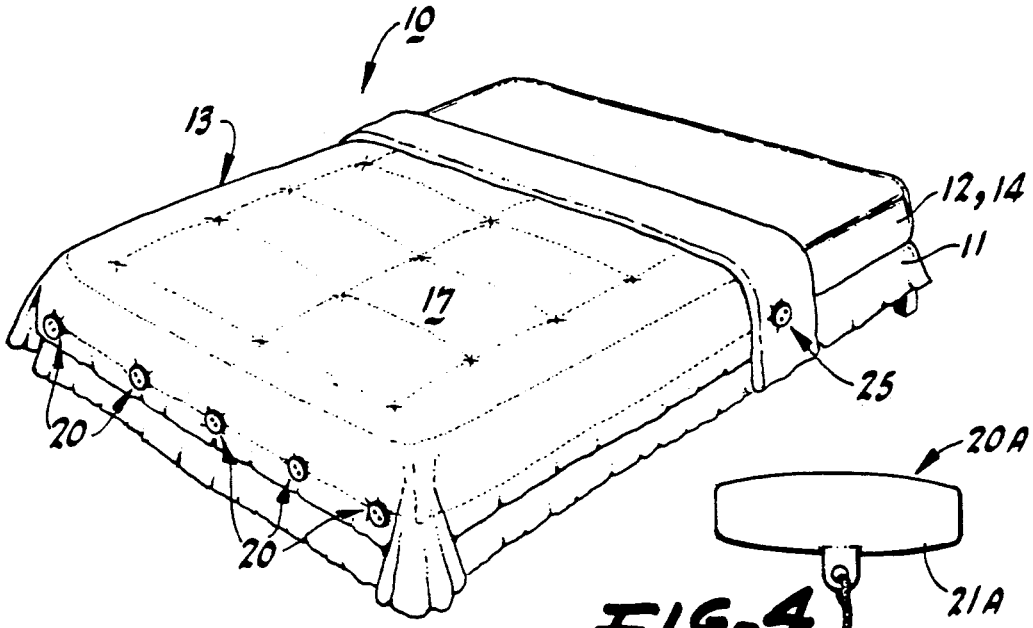
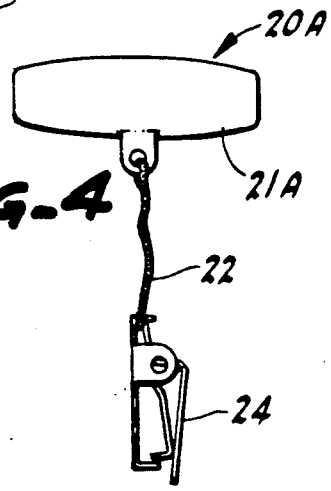
FIG-4
FIG-8
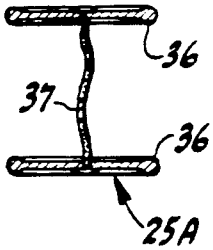
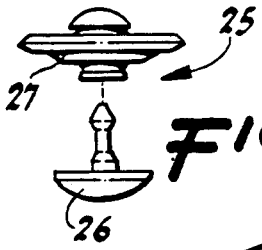
FIG-7
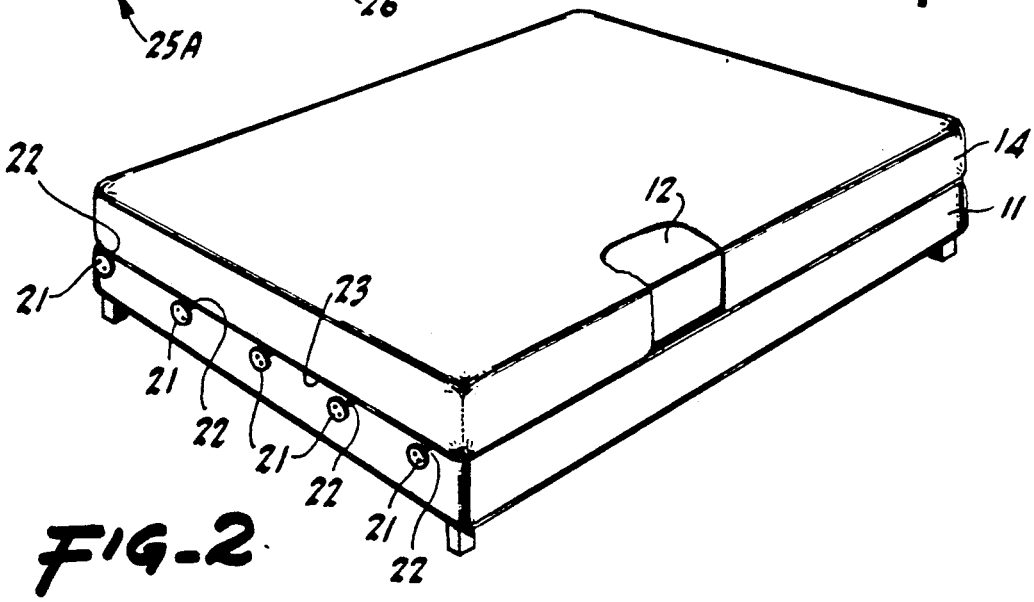
FIG-2

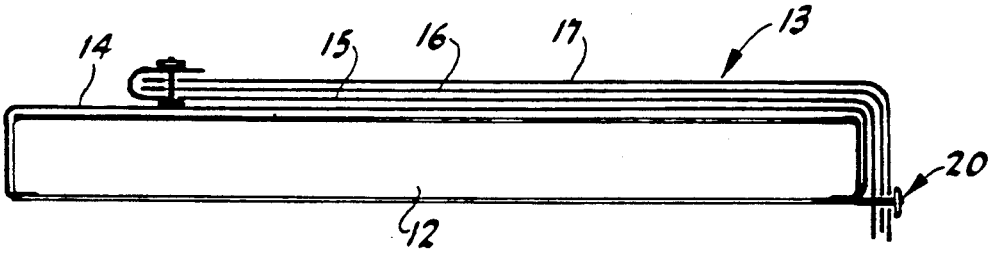
FIG-3
FIG-5
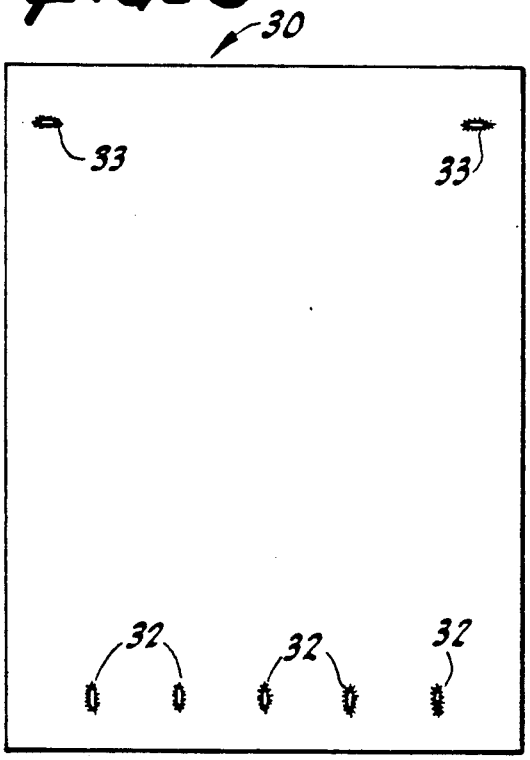
FIG-6
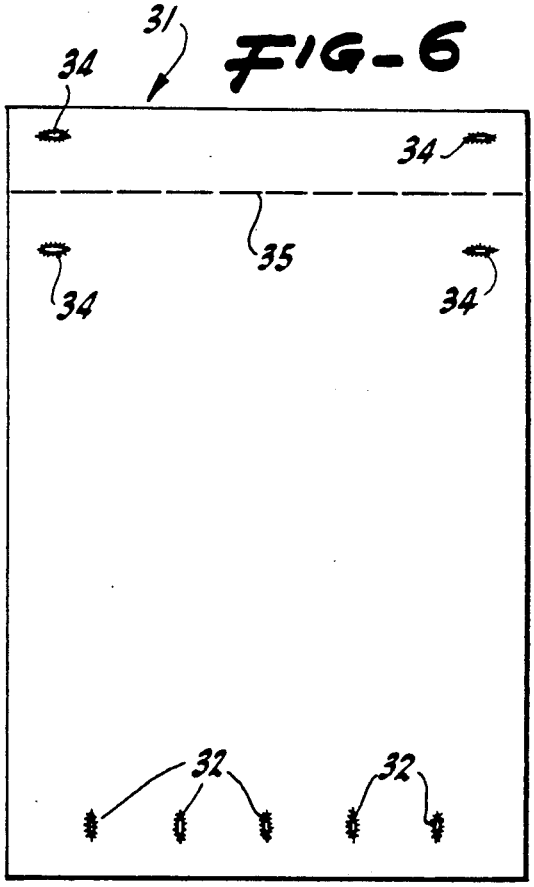
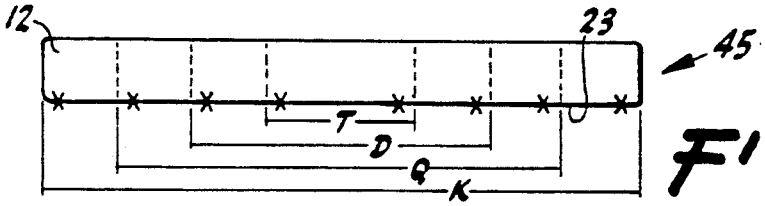
FIG-10
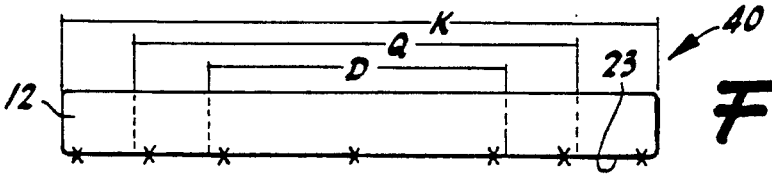
FIG-9

BUTTON ALIGNMENT AND STABILIZING SYSTEM FOR BEDDING

FIELD OF THE INVENTION

The present invention relates to systems and methods for retaining bed coverings in a desired position on a bed.

BACKGROUND OF THE INVENTION

In this application, the terms bed linens, bed coverings, and bed clothing are used interchangeably.

Linens or bed coverings typically are applied to a bed as parallel, concentric layers which are either tucked in or left hanging. There are available a number of fastening schemes for tying or otherwise fastening bed linens in place once the bed has been made. However, such fastening techniques are complicated and/or must be done each time the bed is remade. That is, the covers are refastened to the bed each time the bed is remade. These techniques do not substantially lessen the effort involved, either in making or remaking a bed.

It is one object of the present invention to provide a system and method for attaching linens or bed coverings to a bed in a manner which reduces the effort required to remake the bed.

It is another, related object to provide a system and method for attaching linens or bed coverings to a bed in a manner which simplifies and reduces both the effort required to make the bed initially as well as that required to remake the bed.

It is still another, closely related object to provide a system and method for fastening linens or bed coverings to a bed such that the coverings are automatically aligned and retained in parallel concentric layers until they are removed.

SUMMARY OF THE INVENTION

In one aspect, my invention which achieves the above objectives is embodied in components for securing bed coverings to supports such as mattresses and aligning the bed coverings on the support, which components include: at least a plurality of fastening devices adapted for attachment to the foot of the bedding support such as a mattress and preferably to the bottom welt thereof; and one or more bed coverings which are adapted individually for receiving the plurality of fastening devices to secure the cover(s) to the support and to thereby automatically locate and align the cover(s) with respect to the foot of the support. By the simple expedient of attaching the coverings via the fastening devices to the foot of the support (and, preferably, to the bottom foot end welt in the case of a mattress) when the bed is initially made using the adapted coverings, the coverings are easily made and remade by pulling on them from their upper end, i.e., from the head of the bed. In one preferred aspect, the fastening devices may be buttons or bars attached via shanks and suspender clips to the bedding support, along the bottom foot end welt thereof. Preferably, five of the bottom or other fastening devices are attached to the bottom foot end welt of the mattress for automatically locating and aligning the covering(s) when full, queen- or king-size mattresses are used.

In another aspect, the bed coverings may be adapted for attachment to one another along their upper corners or edges. For example, button tacks may be used to fasten together layers of bedding such as sheets and blankets, etc., via aligned button holes formed along the upper corners and/or edges of the bedding.

In another aspect, my invention resides in a bed having support means such as a mattress and springs, comprising: at least a plurality of fastening devices secured at spaced intervals preferably along the bottom welt at the foot of the support for securing bed coverings thereto without interfering with a fitted bottom sheet; at least a plurality of sheet-like coverings for the support, each covering being adapted for receiving the fastening devices, to secure the covering to the support and to align the coverings relative to one another and to the support; and means for securing the coverings together, one to the other, near the opposite top edges thereof.

In contract to prior art fastening techniques, my present invention is characterized by non-interference with the fitted bottom sheet, by simplicity of structure and method and by the need to fasten the covers only once, when the bed is made, without repetition when the bed is remade.

In still another aspect, my invention relates to a method of making a bed. Initially, the coverings are fastened to the foot of the mattress, via a number of fasteners attached preferably to the bottom foot-end welt of the mattress, then the coverings are pulled taut from the head of the bed so that the coverings are automatically aligned relative to the foot of the bed. The upper edges/corners of the coverings may then be fastened together. As a result of this approach, the process of initially making the bed and any subsequent remaking of the bed are facilitated, both in terns of the effort involved and in terms of more easily achieving aligned, wrinkle-free layers.

BRIEF DESCRIPTION OF THE DRAWINGS

The above and other aspects of my present invention are discussed with respect to the included drawings, in which:

FIG. 1 is a perspective view of a bed showing the bed coverings aligned and retained on a mattress by a preferred embodiment of the button stabilizing and alignment system of my present invention;

FIG. 2 is a perspective view which is similar to FIG. 1, but exposes that portion of the button stabilizing and alignment system which is at the foot of the bed, i.e., FIG. 2 shows the bed linen removed or folded away from the button retaining system at the foot of the bed;

FIG. 3 is a simplified vertical cross-sectional view taken longitudinally along the bed of FIG. 1, illustrating the use of the button stabilizing and alignment system of my present invention to attach multiple bedding layers including sheets, blankets, spreads, etc., to the bed, without interfering with the bottom fitted sheet and such that the bedding is held aligned with the mattress or other support at the foot of the bed;

FIG. 4 depicts a preferred tie-down fastener comprising a suspender clip, a shank and a button or bar;

FIG. 5 is a simplified plan view f a sheet or other covering showing the relative positions of the holes for tie-down fastener devices (at the foot of the bed) and of holes for button tack fastener devices (at the sides of the bed);

FIG. 6 is a plan view in the manner of FIG. 5, of a fold-over sheet or other covering, showing the relative positions of the holes for tie-down fasteners at the foot of the bed and showing holes for button tacks at the top, fold-over section;

FIGS. 7 and 8 illustrate two types of button tack fasteners which can be used in implementing my present invention; and FIGS. 9 and 10 depict two possible standardized fastener arrangements, each of which provides upward and downward compatibility for different-sized covers.

DETAILED DESCRIPTION OF THE PREFERRED EMBODIMENT(S)

Conventionally, linens or bed coverings are applied to a bed as parallel, concentric layers and tucked in or left hanging. When a bed is remade, a substantial part of the effort required is in re-establishing this parallel concentric pattern at the foot of the bed. Having established that the foot is square, linens are pulled taut individually to establish a smooth wrinkle-free surface. Then, the linens are tucked in.

FIG. 1 depicts a perspective view of a bed that includes my button alignment and stabilizing system 10. This system is derived from the above analysis of the process of making and remaking beds. Referring also to FIGS. 2 and 3, the bed may include box springs 11 and a box mattress 12 which are covered by bedding 13 that may include coverings such as fitted bottom sheet 14, top sheet 15, one or more blankets 16—16, and a top cover such as a decorative quilt 17.

The bedding/bed covering 13 is aligned and affixed to the foot of the bed by a plurality of cover-to-mattress fastening means such as the illustrated button fasteners 20 (preferably, three or more fasteners are used depending upon the width of the bed). Referring further to FIGS. 1 and 2, each of the illustrated fasteners 20 may comprise a button 21 which is sewn or otherwise permanently or removably attached to the foot of the mattress 12, preferably to the bottom welt 23 at the foot of the mattress, by a shank 22 of length selected to extend through the aligned cover button holes of the various cover elements (see FIGS. 5 and 6) and to extend around the bottom fitted sheet if such is used.

Preferably, and referring to FIG. 4, the fastening means 20 comprises a toggle or bar 21A attached to a shank 22 which in turn mounts a clip 24. The illustrated clip 24 is a toothed operable spring clip, of the type used on suspenders and thus may be readily removed from and reattached to the mattress. Of course, other types of fastening devices all may be used as well. Those of usual skill in the art will use and derive various additional alternative fastening means which are within the scope of the present invention. For example, the fasteners can be attached to other components of the bed such as the box springs. A metal shank button with a clasp could be used. Various types of shanks may be used, including cloth, plastic, spring and other types of elastic shanks.

As indicated above, preferably the fasteners 20 or other suitable fasteners are attached along the lower edge of the foot of the support (e.g., the bottom welt located at the foot edge of a mattress), so as not to interfere with a fitted sheet if such is used. Also, it is preferred that the other buttons or other fasteners of the generally linear array be mounted close to the corner of the mattress but not in the corner, so as to maintain the bedding in alignment and wrinkle-free along the entire foot of the mattress, yet not interfere with the ability of the fitted sheet to grip the corner of the mattress. For example, for a standard double-, queen- or king-sized mattress, five fasteners can be attached along the bottom foot-edge welt of the mattress, while preferably three such fasteners are used for a twin mattress. For each case, the outermost buttons at the end of the array are positioned approximately two to three inches inside, i.e., from the corner of, the mattress. Such an arrangement satisfies the multiple goals of establishing wrinkle-free alignment of the bedding along the entire foot of the mattress without interfering with the ability of a fitted sheet to grip the mattress along the foot and at the corners of the mattress.

Referring further to FIGS. 1-3, preferably my button alignment and fastening system 10 includes cover-to-cover fastening means 25 such as button tacks which are used to fasten the opposite top (head) edges of the covers 13 together. Referring also to FIGS. 5 and 6, in a presently preferred arrangement, the coverings 14–17, etc., include in addition to the button holes 32, aligned button holes 33 or 34 at the upper edges thereof for receiving the button tack fasteners 25. Although various types of button holes may be used, preferably reinforced button holes are used, such as key hole button holes with a gimp. As sown in FIG. 7, the button tacks 25 may be mating male and female buttons 26 and 27 of the type shown in U.S. Pat. No. 1,742,064. Obviously, numerous adaptations and modifications of the button tack type of fastening arrangements will be derived by those of usual skill in the art. For example, the button tack may be of the type which itself forms the hole through the coverings. Also, and referring to FIG. 8, the cover-to-cover fastening means 25 may comprise a pair of buttons 36—36 which are attached to an intermediate shank 37. In use, one of the buttons of a tack is simply inserted through the aligned button holes at the edges of the layered covers (or the hole-forming tack is inserted through the covers) to affix the covers to the button tack at that edge.

The exemplary bed covering button hole arrangement 30 shown in FIG. 5 is for relatively short coverings 13 which are not folded over, while the arrangement 31 shown in FIG. 6 is for coverings 13 which may be folded over. The non-folding arrangement 30 includes vertically-oriented holes or slits 32 at the foot of the covering for receiving the cover-to-mattress fasteners 20 as well as vertical holes or slits 33 at the top edge for fastening to the other bed covers via the cover-to-cover fasteners 25. The folding arrangement 31 includes the foot button holes 32 and a pair of mating holes 34 at each top edge which receive a button tack 25 or other fastener when the covering is folded, approximately along fold line 35. It is intended that combinations of the fold-over and non-fold-over covers, such as fold-over sheets and non-fold-over blankets and quilts, are to be used together and this goal is readily accomplished when coverings are formed so the position of the corresponding button holes coincide.

Where exposed buttons/button holes would be objectionable (for example, in quilts), the underside of the top layer of the bed covers may incorporate button-receiving tabs which have the button hole formed therein. Also, button holes can be retrofit conveniently in existing linens using a machine which forms the button holes in single or gang fashion. Although various types of button holes may be used, preferably reinforced button holes are used, such as key hole button holes with a gimp.

The fasteners 20 may be applied in a standardized pattern and configuration which is consistent from twin-, to double-, to queen-, to king-sized beds so that, for instance, a queen-sized blanket could be used on a double bed or vice versa without moving button fasteners or changing other linens. One such configuration, designated 40, is shown schematically in FIG. 9, for double-, queen- and king-sized mattress, respectively. (Please note, the relative dimensions of the double-, queen- and king-sized mattresses are not to scale. Also, in FIGS. 9 and 10, the twin, double, queen and king mattresses are identified as T, D, Q and K, respectively, and the various button locations along the button welt 23 are designated "x".) As shown in FIG. 9, the configuration D for the double mattress comprises three fasteners while the configuration Q for the queen adds two additional fasteners for a total of five and the configuration K for the king adds still two more fasteners for a total of seven. As illustrated, the location of the interior button fasteners coincide, that is, the queen includes the three button fasteners from the double and the king includes the five button fasteners from the queen.

Using this or other standardized patterns which will be readily devised by those skilled in the art, the blankets are upwardly and downwardly interchangeable. For example, the double blankets and sheets can be attached to the queen- and king-sized mattress, the queen-sized sheets and blankets can be applied to the double- and king-sized mattress and the king-sized sheets and blankets can be applied to the double- and queen-sized mattress. Quite obviously, because of the difference in sizes, all the various combinations may not provide the desired appearance or coverage (for example, a double sheet or blanket may not adequately cover a king-sized bed and a king-sized sheet or blanket may overflow onto the floor when applied to a double-sized mattress). However, it is contemplated that the standardized button and button-hole configuration will provide greater interchangeability for those coverings which are relatively close in size such as, for example, queen and double, or queen and king.

FIG. 10 depicts still another standardized pattern, one designated 45, which encompasses twin mattresses, T, as well as double-, queen- and king-sized mattresses. Obviously, numerous additional standardized fastener arrangements are possible. For example, the configuration 45 may include three fasteners for the twin instead of two and, thus, five, seven and nine fasteners for the double, queen and king. Alternatively, in either configuration 40 or 45, the same two outer fasteners 20 can serve the double, queen and/or king sizes. For example, the queen and king fasteners can be omitted and the outer double-mattress fasteners used for the queen and king as well. This is not a preferred arrangement because, as mentioned, it is desirable that each size of mattress have outer buttons which are positioned close to the corner of the mattress.

As mentioned above, my invention is derived from an analysis of the process of making and remaking beds described in the first paragraph of this section. My invention uses a plurality of buttons or other fasteners mounted symmetrically along the bottom edge or welt of the foot of a mattress, preferably with the outermost fastener on each size located close to but not in the corner of the mattress. By placing matching holes in the top sheet (and in the bottom sheet where such is not fitted) and in all other upper layers of bedding, all bedding can be buttoned together at the foot of the bed when the bed is initially made, thereby automatically positioning the layers of bedding in the desired parallel, concentric alignment and maintaining the layers in this alignment until the bedding is removed. Thus, the time-consuming first step in making the bed is eliminated and the process of initially making the bed and of remaking the bed are made easier.

Furthermore, by fastening together the top edges of the bed coverings, making the bed (after the simplified step of securing the foot of the coverings to the bed or mattress) and remaking the bed is as simple as pulling each corner to the head of the bed. The bed is easily made and remade, even by a child, wrinkle-free and with the covers aligned, linens do not pull out during use, and, the foot once tucked in, remains tucked in. In addition, the linens are easy to change and to wash in the normal manner and may be used on other beds/mattresses which do not incorporate my alignment system.

Having thus described preferred and alternative arrangements of my invention those of usual skill in the art will readily derive modifications thereof which are within the scope of the claims.

I claim:

1. A combination comprising a bed cover, a mattress, and components for securing bed coverings to said mattress comprising: a multiplicity of spaced-apart fastening means attached to a bottom foot-end welt of the mattress in a standardized pattern; the cover including a multiplicity of complementary fastening means spaced apart according to said standardized pattern for attachment to the multiplicity of fastening means for securing the cover along the entire length of the bottom foot-end welt of the mattress without interference with a fitted sheet, and wherein the fastening means is a button or bar attached via a shank to the mattress foot end welt and the complementary fastening means is a hole, thereby automatically aligning the cover relative to the bottom foot-end welt of the mattress.

2. The combination of claim 1, wherein the standardized pattern of fastening means and complementary fastening means are adapted for at least two different sized mattresses.

3. The combination of claim 1, wherein the standardized pattern of fastening means and the complementary fastening means are adapted for at least two different sized mattresses selected from twin, double queen and king.

4. The combination of claim 1, 2, or 3, including at least a plurality of covers designed to be positioned one overlying the other, and wherein the individual coverings are adapted according to the standardized pattern for receiving the fastening means.

5. The combination of claim 4, wherein the fastening means include a suspender clip for attaching the shank to the mattress.

6. The combination of claim 4, further comprising cooperating fastening means at the top edges of the coverings for securing the coverings one to the other.

7. The combination of claim 1, wherein the fastening means is permanently formed as part of the mattress.

* * * * *